US006293893B1

(12) United States Patent
Truchelut

(10) Patent No.: US 6,293,893 B1
(45) Date of Patent: Sep. 25, 2001

(54) PHYSICAL FITNESS ACCESSORY

(76) Inventor: Gary Truchelut, 3451 Rolling Hills Dr., Nacogdoches, TX (US) 75961

( * ) Notice: Subject to any disclaimer, the term of this patent is extended or adjusted under 35 U.S.C. 154(b) by 0 days.

(21) Appl. No.: 09/659,564

(22) Filed: Sep. 11, 2000

Related U.S. Application Data

(60) Provisional application No. 60/160,198, filed on Oct. 19, 1999.

(51) Int. Cl.[7] ..... A63B 21/065; A63B 21/002

(52) U.S. Cl. ..... 482/121; 482/92

(58) Field of Search ..... 482/148, 121, 482/122, 124, 126, 92, 91, 14, 12, 20, 44, 15, 74, 907; 446/473; 43/6; D21/662, 679

(56) References Cited

U.S. PATENT DOCUMENTS

| | | | | |
|---|---|---|---|---|
| D. 267,261 | | 12/1982 | Pataluch . | |
| D. 274,171 | | 6/1984 | Gabrielidis . | |
| D. 325,945 | | 5/1992 | Gross . | |
| D. 341,169 | * | 11/1993 | Denton | D21/108 |
| D. 385,604 | * | 10/1997 | Moore | D21/198 |
| D. 388,848 | * | 1/1998 | Sontz et al. | D21/198 |
| 2,803,087 | * | 8/1957 | Zalkind . | |
| 4,591,151 | | 5/1986 | Hensley . | |
| 5,004,226 | | 4/1991 | Brown, Jr. . | |
| 5,022,648 | | 6/1991 | Travis . | |
| 5,147,262 | * | 9/1992 | Hymanson | 482/110 |
| 5,514,055 | | 5/1996 | Elliott . | |
| 5,542,667 | * | 8/1996 | Lezdey et al. | 273/84 |
| 5,674,166 | | 10/1997 | Gordon . | |
| 5,868,651 | | 2/1999 | Washington . | |
| 5,891,003 | * | 4/1999 | Deac et al. | 482/106 |

FOREIGN PATENT DOCUMENTS

| | | |
|---|---|---|
| 2107596 | 5/1983 | (GB) . |
| 8909083 | 5/1989 | (WO) . |

* cited by examiner

*Primary Examiner*—Stephen R. Crow
(74) *Attorney, Agent, or Firm*—Richard C. Litman

(57) ABSTRACT

The physical fitness accessory is an exercise device that is used while a person is walking. The exercise device is an elongated, flexible fiberglass bar having variable diameter. The diameter of the exercise bar is greatest at the middle or midpoint of the bar with the diameter tapering in both directions from the midpoint of the bar. One end of the exercise device is straight while the other end of the exercise device is bowed, having slight to moderate curvature, which allows the exercise device to rest comfortably against a person's body.

10 Claims, 4 Drawing Sheets

PHYSICAL FITNESS ACCESSORY

CROSS-REFERENCE TO RELATED APPLICATION

This application claims the benefit of U.S. Provisional Patent Application Serial No. 60/160,198, filed Oct. 19, 1999.

BACKGROUND OF THE INVENTION

1. Field of the Invention

The present invention relates generally to exercise equipment and more particularly, to a flexible fiberglass exercise bar with a removable center pad and a rubber handle at each end. The exercise bar of the present invention is used to facilitate the strengthening of the arms and upper body and for toning exercises.

2. Description of Related Art

Walking is an excellent way of staying in shape and maintaining a person's physical fitness. Walking provides a person with a good cardiovascular workout as well as toning and strengthening the legs and the lower body. A number of ways have been suggested to obtain an upper body workout while a person is enjoying a daily walk, for example, carrying a pair of weights while walking. However, these methods are limited in the conditioning benefit that they provide the walker and they are inconvenient and often uncomfortable to perform during a walk.

There is a clear unfulfilled need for a method of achieving an superb workout for the muscles of the arms and the upper body while walking. A method that is straightforward, comfortable, and inexpensive is needed to enhance the exercise benefit of the daily walk so many people enjoy taking everyday. Such a method would provide the daily walker with an invigorating total body workout that strengthens and tones the muscles of the arms, upper body, legs, and lower body.

The prior art describes a number of exercise accessories that can be used while a person is exercising, for example, an aerobic wand is described in U.S. Pat. No. 5,022,648 issued on Jun. 11, 1991 to S. Travis. The aerobic wand consists of sections of elongated tubes that are joined together by a cylindrical, centrally located tension spring mechanism. U.S. Pat. No. 5,514,055 issued on May 7, 1996 to D. K. Elliot describes an exercise and stress-relief device that consists of a bending tube and a cover. The bending tube contains a longitudinally disposed helical spring.

An isotonic or isometric exercise and physical therapy system is described in U.S. Pat. No. 5,674,166 issued on Oct. 7, 1997 to J. R. Gordon. The exercise and therapy system is based on a series of elongated exercise rods made of a urethane elastomeric resin that is both bendable and twistable. U.S. Pat. No. 5,868,651 issued on Feb. 9, 1999 to L. A. Washington describes a multi-function exercise device. The multi-function exercise device consist of a center bar member, a left side bar, and a right side bar member wherein the left side bar member is pivotally coupled to the left end of the center bar member and the right side bar member is pivotally coupled to the right end of the center bar member.

A resilient exercise apparatus is described in WIPO publication no. WO 89/09083 published in October 1989. The apparatus has a filament matrix having an oblong shape and composed of fiberglass fibers with a resin filler, the matrix being encased in an extruded rubber compound sheath to form a cylindrical rod. U.S. Pat. Des. No. 267,261 issued on Dec. 14, 1982 to C. J. Pataluch describes an ornamental design for an exercise bar. An ornamental design for a physical exerciser is described in U.S. Pat. Des. No. 274,171 issued on Jun. 5, 1984 to P. Gabrielidis. U.S. Pat. Des. No. 325,945 issued on May 5, 1992 to J. S. Gross describes an ornamental design for a stretching exerciser for golfers or the like.

None of the above inventions and patents, taken either singly or in combination, is seen to describe the instant invention as claimed.

SUMMARY OF THE INVENTION

Accordingly, it is a principal object of the invention to provide an exercise device that when used in conjunction with walking provides a total body workout.

It is another object of the invention to provide an exercise device that strengthens and tones the muscles of the arm and upper body.

It is a further object of the invention to provide an exercise device that provides variable tension for isometric exercises.

Still another object of the invention is to provide an exercise device that is lightweight, convenient, and comfortable to use.

It is an object of the invention to provide improved elements and arrangements thereof in an exercise device for the purposes described which is inexpensive, dependable and fully effective in accomplishing its intended purposes.

To meet the above objectives, the present invention provides an exercise device with variable tension. The exercise device of the present invention comprises an elongated, flexible fiberglass bar having variable diameter. The diameter of the exercise bar is greatest at the middle or midpoint of the bar with the diameter tapering in both directions from the midpoint of the bar. One end of the exercise device is straight while the other end of the exercise device has slight to moderate curvature which allows the exercise device to rest comfortably against a person's body.

The curved end of the exercise device is smaller in diameter than the straight end of the exercise device and the curved end is more flexible than the straight end. The flexing differential between the straight end and the curved end allows for different tensions for the same applied force which provides a more comprehensive isometric workout and allows a greater range of motion during use which provides for an excellent isotonic workout.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
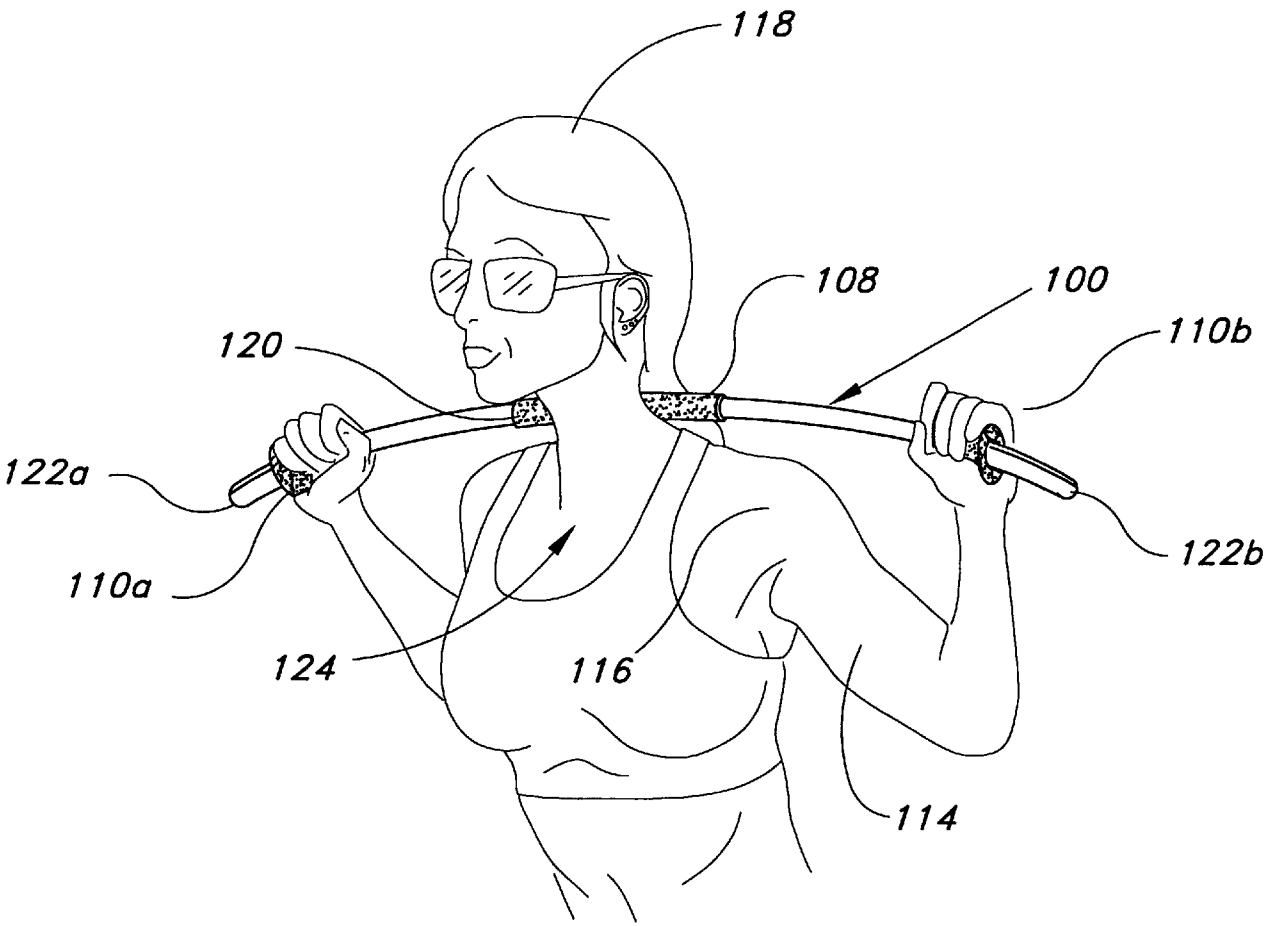
FIG. 1 is an environmental, perspective view of an exercise bar being used according to the present invention.
Figure 2A:
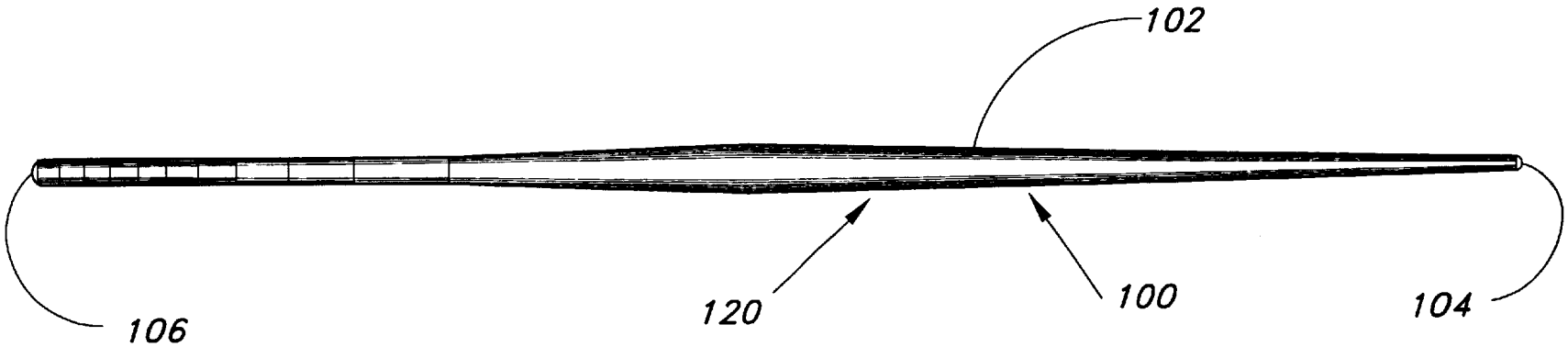
FIG. 2A is a front view of a bare exercise bar without a pad and rubber grips.
Figure 3:
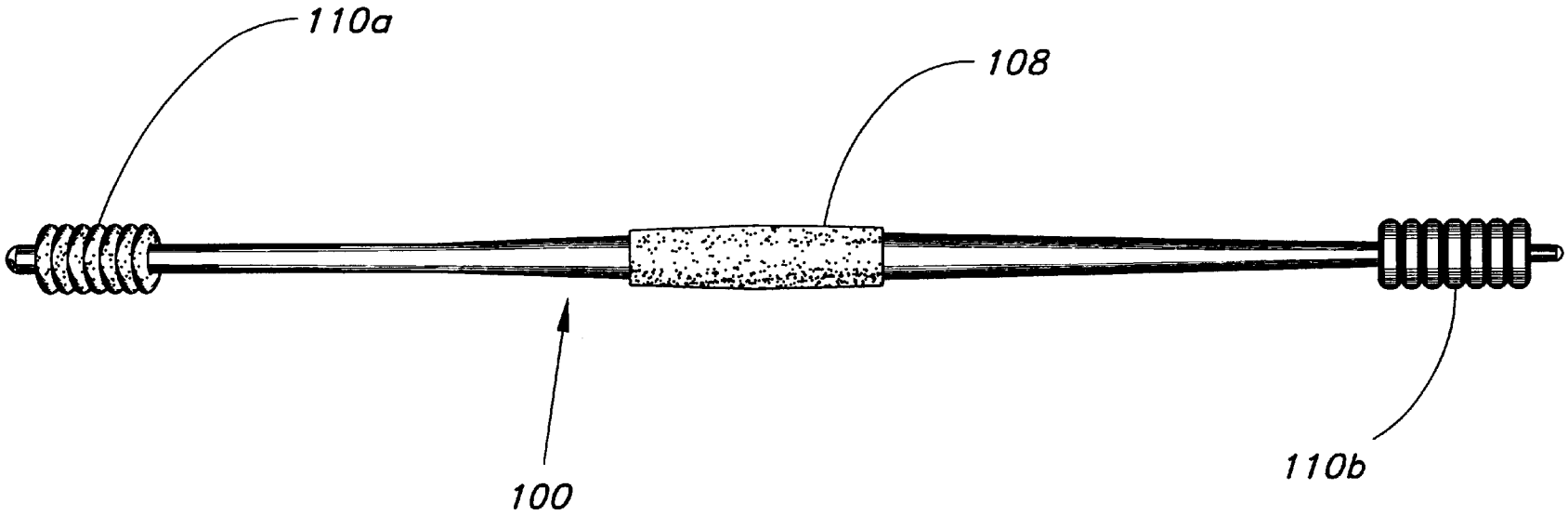
FIG. 3 is a front view of a bare exercise bar with a centrally disposed pad and a pair of laterally disposed rubber grips.

Referring to FIG. 1 which is an environmental, perspective view of a person 118 using the exercise device 100 of the present invention. The exercise device 100 of the present invention comprises a flexible lightweight elongated bar 112, a removable centrally disposed pad 108, and a pair of laterally disposed hand grips (110*a*, 110*b*) as depicted in FIG. 3. In a preferred embodiment, the bar 112 is made of fiberglass and is 54 inches in length, and the grips (110*a*, 10*b*) are made of rubber and are 12 inches in length. However, the bar 112 can be any appropriate length and can be made of any suitable lightweight flexible material, and the grips (110*a*, 110*b*) can be of any appropriate length and can be made of any suitable material that is comfortable to grasp. In the preferred embodiment, the centrally disposed pad 108 is made of foam and is 18 inches in length, however, any suitable padding material could be used and any appropriate length of padding 108 could be used. The flexible elongated bar 112 has variable diameter with the maximum diameter of the bar 112 occurring at the midpoint 102 of the bar 112 with the diameter of the bar 112 tapering in both directions from the midpoint 102 of the bar 112 as shown in FIG. 2A.

Figure 2B:
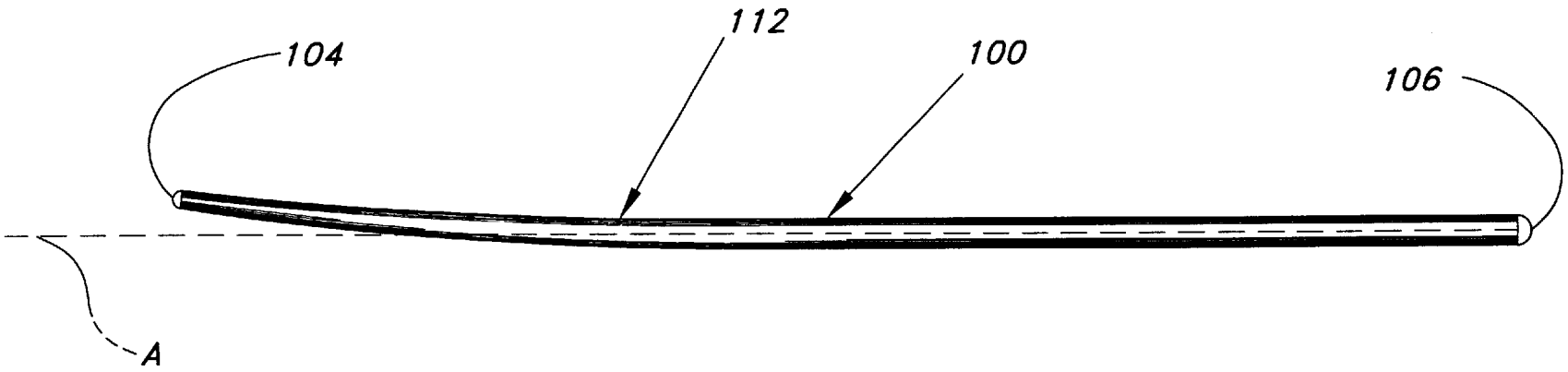
FIG. 2B is a top view of a bare exercise bar without a pad and rubber grips.

The flexible elongated bar 112 has a unique and innovative contoured design that creates a tension or resistance differential between the lateral portions (122*a*, 122*b*) of the exercise device 100. The resistance differential is created by having the elongated bar 112 bowed at one end 104 and straight at the other end 106 and by the variable diameter of the elongated bar 112 as depicted in FIG. 2B. In a preferred embodiment, the midpoint 102 diameter of the bar 112 is 2 inches and the minimal diameter of the straight end 106 is 1 inch. The bowed end 104 is smaller in diameter than the straight end 106 which allows for more flexing when pressure is applied thus allowing one arm or lateral portion 122*b* to move with the other arm or lateral portion 122*a* staying in position. Furthermore, the straight end 106 offers less resistance than the bowed end 104 which allows for more extended movement with the same pressure applied at both ends (104, 106). This differential resistance allows for a greater range of motion at the bowed end 104 than at the straight end 106 which adds to the exercise benefits of each repetition. In a preferred embodiment, the bowed end 104 is curved so that the tip of the bowed end 104 deviates from an axis A extending through the center of the straight end 106 and the midpoint 102 of the bar 112, as shown in FIG. 2B. In a preferred embodiment, this deviation from the axis A measures about two inches normal to the axis A.

The exercise device 100 of the present invention is designed to be used with three point contact with the body. Pressure is applied at one or both ends (104, 106) with the center pad 108 resting at the waist (not shown), back (not shown), shoulders 116, or legs (not shown). The medial portion 120 of the exercise device 100 rests against some portion of a person's body as depicted in FIG. 1. The centrally disposed pad 108 cushions the contact between the exercise device 100 and a person's body. Each lateral portion (122*a*, 122*b*) of the exercise device 100 has a sturdy rubber grip (110*a*, 110*b*) for grasping. With the comfortable padded medial portion 120 of the exercise device 100 resting against the base of the neck 124 as depicted in FIG. 1, the lateral portions (122*a*, 122*b*) of the exercise device 100 are slowly pulled forward which creates a restoring tension in the exercise device 100. The resistance produced by the exercise device 100 causes a dramatic increase in the muscle tone of the involved muscles (in this case, the arms 114, back, and shoulders 116) with minimal contraction of the involved muscles, therefore, the involved muscles receive a thorough isometric workout. Thus, a superior isometric workout is achieved by simply positioning the padded medial portion 120 of the exercise device 100 against the body, for example, the base of the neck 124, the chest, the abdomen, or the back and bending the lateral portions (122*a*, 122*b*) of the exercise device 100 in the desired direction. The exercise device 100 of the present invention can also be used to perform other isometric exercises, for example, the tip of the bowed end 104 can be placed under the foot and the elongated bar 112 bowed in the same manner as an archery bow would be when attaching a string to an archery bow.

Exercises are performed using the exercise device 100 of the present invention in sets of 8 to 12 repetitions by applying a steadily increasing pressure or force to the handles (110*a*, 110*b*) of the device 100 while counting to 5 and then gradually lessening the pressure to the count of 5. This is usually done in time with the steps taken while walking. One complete repetition takes 10 steps or counts and is followed by a rest. This sequence is repeated up to 12 times for each side of the body.

The exercise device of the present invention greatly increases the physical fitness benefits of walking. The exercise device of the present invention can be used to perform a wide range of upper body exercises that increase cardiovascular fitness as well as tones and strengthens muscles. The exercise device of the present invention can be used indoors while standing or sitting which makes the exercise device of the present invention useful in rehabilitation therapy and for wheelchair patients. Furthermore, the exercise device of the present invention can be used to perform isotonic exercises.

The preferred embodiments of the present invention disclosed herein are intended to be illustrative only and are not intended to limit the scope of the invention. It should be understood by those skilled in the art that various modifications and adaptations of the present invention as well as alternative embodiments of the present invention may be contemplated. It is to be understood that the present invention is not limited to the sole embodiments described above, but encompasses any and all embodiments within the scope of the following claims.

I claim:

1. An exercise device comprising:

an elongated, flexible bar having a first end and a second end and having a variable diameter whereby the diameter of said bar being maximum at the middle of said bar and the diameter of said bar tapering in both directions from the middle of said bar, the diameter of said first end of said bar being smaller than the diameter of said second end of said bar; and said first end of said bar being bowed and said second end of said bar being straight.

2. The exercise device according to claim 1, wherein:

said bowed end of said bar is more flexible than said straight end.

3. The exercise device according to claim 2, wherein:

said elongated, flexible bar is made of fiberglass.

4. The exercise device according to claim 3, further comprising:

a pad centrally disposed on said bar.

5. The exercise device according to claim 4, further comprising:

a pair of grips laterally disposed on said bar.

6. The exercise device according to claim 5, wherein:

said grips are made of rubber.

7. The exercise device according to claim 6, wherein:

said bar has a length of 54 inches.

8. The exercise device according to claim 7, wherein:

the diameter at the middle of said bar is 2 inches.

9. The exercise device according to claim 8, wherein:

the diameter of the bowed end of said bar is 1 inch.

10. The exercise device according to claim 9, wherein:

the tip of the bowed end is disposed 2 inches normal to an axis extending through the center of the first end and the middle of said bar.

* * * * *